US009224400B2

(12) United States Patent
Wilson et al.

(10) Patent No.: US 9,224,400 B2
(45) Date of Patent: Dec. 29, 2015

(54) DOWNMIX LIMITING

(75) Inventors: Rhonda Wilson, San Francisco, CA (US); Michael Ward, San Francisco, CA (US); Steven Venezia, Simi Valley, CA (US); Roger Dressler, Bend, OR (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 284 days.

(21) Appl. No.: 13/884,569

(22) PCT Filed: Nov. 10, 2011

(86) PCT No.: PCT/US2011/060128

§ 371 (c)(1), (2), (4) Date: May 9, 2013

(87) PCT Pub. No.: WO2012/064929

PCT Pub. Date: May 18, 2012

(65) Prior Publication Data

US 2013/0230177 A1 Sep. 5, 2013

Related U.S. Application Data

(60) Provisional application No. 61/413,237, filed on Nov. 12, 2010.

(51) Int. Cl.
*G10L 19/008* (2013.01)

(52) U.S. Cl.
CPC ..... *G10L 19/008* (2013.01); *H04S 2400/03* (2013.01)

(58) Field of Classification Search
CPC ..... G10L 19/008; H04S 2400/03
USPC ..... 381/22
See application file for complete search history.

(56) References Cited

U.S. PATENT DOCUMENTS 3,252,105 A 5/1966 Patchell
6,122,619 A * 9/2000 Kolluru et al. ..... 704/500

(Continued)

FOREIGN PATENT DOCUMENTS

CN 101243491 8/2008
CN 101529898 9/2009

(Continued)

OTHER PUBLICATIONS

Gerson, M. et al. "MLP Lossless Compression System" Meridian Audio Ltd. Huntingdon, England, AES Conference, 17th International Conference, Aug. 1999.

(Continued)

*Primary Examiner* — Sonia Gay

(57) ABSTRACT

The invention relates to downmixing techniques by which output audio signals are obtained from input audio signals partitioned into subgroups. A variable common gain limiting factor is applied to all downmix coefficients that govern the contributions from the input signals in a subgroup. While preserving the proportions between signal values within a subgroup, the invention makes it possible to limit the gain of different input signal subgroups to different extents, so that relatively more perceptible signals can be limited relatively less. It then becomes possible to achieve a consistent dialogue level while transitioning in a less perceptible fashion between signal portions with and without gain limiting. Embodiments of the invention include a method, a mixing system and a computer-program product.

20 Claims, 4 Drawing Sheets

(56) References Cited

U.S. PATENT DOCUMENTS

| | | | | |
|---|---|---|---|---|
| 7,751,572 | B2 | 7/2010 | Villemoes | |
| 2004/0049379 | A1 | 3/2004 | Thumpudi | |
| 2006/0262936 | A1* | 11/2006 | Sato | 381/22 |
| 2008/0071549 | A1 | 3/2008 | Chong | |
| 2008/0208600 | A1 | 8/2008 | Pang | |
| 2009/0150161 | A1 | 6/2009 | Faller | |
| 2009/0222272 | A1 | 9/2009 | Seefeldt | |
| 2010/0092008 | A1 | 4/2010 | Oh | |
| 2010/0286980 | A1 | 11/2010 | Jasiuk | |

FOREIGN PATENT DOCUMENTS

| | | |
|---|---|---|
| RU | 2361185 | 7/2009 |
| WO | 2011/073201 | 6/2011 |

OTHER PUBLICATIONS

Gerson, Michael "Optimum Reproduction Matrices for Multispeaker Stereo" JAES, vol. 40, Jul./Aug. 1992.

* cited by examiner

DOWNMIX LIMITING

CROSS-REFERENCE TO RELATED APPLICATIONS

This application is the U.S. national stage of International Patent Application No. PCT/US2011/060128 filed on Nov. 10, 2011, which in turn claims priority to U.S. Provisional Patent Application No. 61/413,237 filed on Nov. 12, 2010, hereby incorporated by reference in its entirety.

TECHNICAL FIELD

The invention disclosed herein generally relates to analogue or digital audio signal processing technique. More particularly, it relates to downmixing of a number of audio signals into a smaller number of audio signals.

TECHNICAL BACKGROUND

As used herein, downmixing refers to the operation of deriving N output audio signals (or channels) from information encoded by M input audio signals (or channels), where $1 \leq N < M$. Common expectations on high-quality downmixing include low information loss, compatible dialogue levels and high psychoacoustic fidelity between the input and output signals.

Downmixing frequently includes combining two signals into one, be it by waveform addition, transform-coefficient addition, weighted averaging or the like. While stereo-to-mono downmixing may be expressed by the simple relationship $$y_1 = \frac{x_1 + x_2}{\sqrt{2}}, \tag{1}$$

general M-to-N downmixing may be written in matrix form as:

$$\begin{bmatrix} y_1 \\ \vdots \\ y_N \end{bmatrix} = \begin{bmatrix} a_{11} & \dots & a_{1M} \\ \vdots & & \vdots \\ a_{N1} & \dots & a_{NM} \end{bmatrix} \begin{bmatrix} x_1 \\ \vdots \\ x_M \end{bmatrix}. \tag{2}$$

Here, the relative weight distribution between input channels contributing to a given output channel $y_k$, as expressed by downmix coefficients $a_{k1}, \dots, a_{kM}$, may follow from artistic considerations or may be related to the spatial layout of the reproducing audio sources. After fixing the relative ratios of the downmix coefficients, the gain of the downmixing may be determined by other concerns, notably energy conservation in cases where one input channel contributes to several output channels. In other situations, the priority may be to maintain a consistent dialogue level. This requirement makes it possible to join audio sections seamlessly together although they have been obtained by different types of mixing or encoding.

A difficulty frequently encountered in downmixing, whether the gain has been chosen by energy conservation or in response to a dialogue-level requirement, is that an output signal exceeds its permitted range. To avoid clipping the output signal or damaging the reproducing audio equipment, a common practice in the art is to reduce the gain, either locally—at or around a point in time where out-of-range values would otherwise be produced—or globally. Supposing that output signal $y_k$ is out of range, the overall gain may be limited as per $$\begin{bmatrix} y_1 \\ \vdots \\ y_N \end{bmatrix} = \gamma \begin{bmatrix} a_{11} & \dots & a_{1N} \\ \vdots & & \vdots \\ a_{N1} & \dots & a_{NM} \end{bmatrix} \begin{bmatrix} x_1 \\ \vdots \\ x_M \end{bmatrix}, \tag{3}$$

where $0<y<1$ is a limiting factor. One may also reduce only the gain of the signals contributing to $y_k$, by $$\begin{bmatrix} y_1 \\ \vdots \\ y_N \end{bmatrix} = \begin{bmatrix} a_{11} & \dots & a_{1M} \\ \vdots & & \vdots \\ a_{k-1,1} & \dots & a_{k-1,M} \\ \gamma a_{k1} & \dots & \gamma a_{kM} \\ a_{k+1,1} & \dots & a_{k+1,M} \\ \vdots & & \vdots \\ a_{N1} & \dots & a_{NM} \end{bmatrix} \begin{bmatrix} x_1 \\ \vdots \\ x_M \end{bmatrix}. \tag{4}$$

Irrespective of how limiting factors are applied, the requirements of meeting the dialogue level and performing the limiting in a psychoacoustically unnoticeable manner are clearly contradictory. Limiting the gain more locally favours the consistency of the dialogue level but leads to more sudden and more perceptible gain changes. Similarly, performing the limiting over an extended time period improves one problem but worsens the other. Hence, there is need for improved downmixing techniques.

SUMMARY

To overcome, alleviate or at least mitigate one or more of the problems associated with the prior art, it is an object of the present invention to provide techniques for downmixing audio streams in a psychoacoustically less noticeable fashion. A particular object of the invention is to provide downmixing techniques that enable a consistent dialogue level while avoiding clipping the output signal(s). Another particular object of the invention is to provide downmixing techniques having these general properties and being suitable for preserving dynamic, temporal and/or spatial properties of the audio.

The invention achieves at least one of these objects by providing a method, a mixing system and a computer-program product in accordance with the independent claims. The dependent claims define advantageous embodiments of the invention.

In a first aspect, the invention provides a method of downmixing a plurality of input audio signals, which carry input data, into at least one output audio signal. The mixing properties of the method are dependent on maximal downmix coefficients, at least one in-range condition on the output audio signal(s), and a partition of the input signals into subgroups. The method includes deriving downmix coefficients from the maximal downmix coefficients by downscaling all maximal downmix coefficients belonging to the same subgroup by a common limiting factor in order to meet the in-range condition(s). The downmix coefficients thus derived are suitable for downmixing the input signals.

In a second aspect, the invention provides a mixing system adapted to perform the method of the first aspect. In a third aspect, the invention provides a computer-program product for causing a programmable computer to carry out the method of the first aspect.

The invention teaches that a common limiting factor be applied to all downmix coefficients controlling the contributions of the input signals in a subgroup out of at least two subgroups. By this latitude in limiting different input signals to different extents, relatively more perceptible signals can be limited relatively less. This makes it easier to combine a consistent dialogue level with discreet transitions between signal portions with and without gain limiting.

With reference to the appended claims, it is noted that a each of the signals may be either analogue (continuous-valued) or digital (discrete-valued). A "subgroup" may include one input signal or several input signals. An "in-range condition" on a signal may refer to an upper bound on the signal, a lower bound on the signal or a requirement for the signal to remain in an interval having a lower and an upper bound. An in-range condition may apply to a particular time segment, a set of time segments or may be global, applying to the entire signal without restriction. It is understood that the terms "in-range condition" and "non-clip condition" may be used interchangeably in this disclosure, as may the terms "limiting factor" and "gain limiting factor". The limiting factor for each subgroup is determined on the basis of not only the maximal downmix coefficients assigned to the input signals as such, but also on the basis of the input data carried by the input signals. Finally, it is noted that the downmixing operation itself, that is, forming linear combinations of the input signals to obtain output signals, may be carried out by techniques that are per se known in the art.

With the exception of non-local in-range conditions, non-local smoothing processes (see below) or similar measures being applied, the invention includes both real-time and offline embodiments, e.g., processing on a file-to-file basis.

In one embodiment, at least one subgroup comprises two or more input signals. Since a common limiting factor is used to downscale downmixing coefficients for all these input signals, significant relationships between several input signals may be preserved under downmixing. Hence, perceived dynamical, temporal, timbral and/or spatial impressions which are conveyed by the input signals as a whole are only affected to a limited extent by downmixing in accordance with this embodiment.

In further developments of the preceding embodiment, the input signals correspond to spatially related audio channels, such as left and right channels; left, centre and right channels; left and right wide channels; left and right centre channels; and left, centre and right surround channels.

In one embodiment, the downmix coefficients are maintained as large as possible. This favours a consistent dialogue level. For example, if the in-range condition is a non-strict inequality, the limiting factors may be set equal or close to their upper values (or 'sharp' values, or 'tight' values, or 'exact' values), that is, values which yield equality in the in-range condition. Preferably, the downmix coefficients should not differ more than 20% from the values determined from the upper bounds, more preferably not more than 10% and most preferably not more than 5%. In embodiments which further include smoothing of the downmix coefficients (see below), it is preferable to impose one of the above conditions on the values which the downmix coefficients have before smoothing.

In one embodiment, the output signal is partitioned into time segments. The time segments may have equal or unequal length; they may be the result of sampling of analogue data, transform-based processing of a signal or may result from some similar process. A time segment may consist of a number of samples. Alternatively, a time segment may consist of a number of blocks, which each comprise a number of samples. The input signal may be partitioned into similar or different time segments, or may be non-partitioned. A method according to this embodiment may attempt to satisfy the in-range condition in each time segment separately, in view of the input data relating to this time segment. The method may be configured to satisfy the in-range condition in all time segments or in some time segments. For slowly varying input signals, the latter option may reduce the computational load at limited quality decrease since not all time segments need be considered.

In a variation suitable for providing downmixing into several output signals, the method may be configured to satisfy the in-range condition in separate time segments, however for all output signals jointly. This may preserve the perceived spatial balance of the output signals.

Embodiments for providing output signals partitioned into time segments may advantageously be combined with smoothing (or regularisation). As one example, the values of a particular downmix coefficient obtained for different time segments may be treated as a (time) sequence and may be subjected to a smoothing operation. The smoothed downmix coefficients may be used in the downmixing operation in place of the non-smoothed downmix coefficients. One or several selected downmix coefficients or all downmix coefficients may undergo smoothing; these processes may operate in parallel to one another. Those skilled in the art will realise that smoothing a limiting factor for a particular subgroup will yield the same result as smoothing the downmix coefficients acting on the input signals in this subgroup; therefore, while both these approaches fall within the scope of the invention, this disclosure need not describe both in detail.

The smoothing may be carried out by any suitable process known per se in the art. Preferably, the smoothing is governed by an upper bound on the rate of change. After smoothing in this manner, an isolated value in the sequence of segment-wise values will be surrounded by a downward and an upward ramp of moderately changing values, so that an abrupt change is avoided. The ramps may be characterised by constant increase or decrease, on a linear or logarithmic scale, such as the dB scale. Hence, by adjusting downmix coefficient values so that one obtains a smoothed downmix coefficient in which the increase or decrease rate (in absolute values) is not too large, gradual and hence less perceptible transitions between gain limited and non-limited portions of the downmixed signals may be obtained. Another preferable option is to carry out the smoothing by adjusting the downmix coefficients by either reducing or maintaining the original values. Increasing the original downmix coefficients should be avoided, as an in-range condition may then no longer be satisfied.

In one embodiment, at least one subgroup of input signals is associated with a lower bound on the limiting factor used to determine the downmix coefficients acting on the input signals in that subgroup. The bound is an a priori bound in the sense that this embodiment of the invention attempts to satisfy the in-range condition on the output signal by looking for solutions above the lower bound only. This ensures that the contribution from the concerned subgroup will not become arbitrarily small.

In a further development of the preceding embodiment, a primary and a secondary subgroup are associated with different lower (a priori) bounds on their respective limiting factors. The lower bound associated with the primary subgroup is greater than or equal to the lower bound associated with the secondary subgroup. This may be used to define a relative balance between the subgroups. For instance, the primary subgroup may be given relatively greater psychoacoustic importance than the secondary subgroup.

In another embodiment, the search for limiting factor values by which to satisfy the in-range condition may be configured to favour the primary group. In particular, a method according to this embodiment may be configured to search for limiting-factor values that satisfy the in-range condition where the primary-subgroup limiting factor is equal to or near an upper bound on the limiting factor for the primary subgroup.

In a variation to the preceding embodiment, upper and lower bounds may be defined for the respective limiting factors for the primary subgroup and the secondary subgroup. A method according to this embodiment is configured to initially look for solutions including the primary-subgroup limiting factor being equal to its upper bound. The secondary-subgroup limiting factor is varied between its upper and lower bound. Then, if no solution to the in-range condition is found, the method looks for solutions including the secondary-subgroup limiting factor being equal to its lower bound. The primary-subgroup limiting factor is varied between its upper and lower bound. Put differently, the method initially sets both limiting factors equal to their maximal values (which will best preserve a consistent dialogue level) and then decreases them in a selective fashion until a pair of limiting factors is found by which the in-range condition is satisfied. The selective decreasing includes initially decreasing the secondary-subgroup limiting factor to its lower bound and then, if needed, decreasing also the primary-subgroup limiting factor. Advantageously, this ensures that the primary channels, which may be defined as the perceptually more important ones, are affected by gain limiting as little as possible.

With reference to the above embodiments wherein a primary and a secondary subgroup are distinguished, the primary subgroup may include signals corresponding to channels that are more important from a psychoacoustic point of view. These include channels intended for playback by audio sources located in a half space in front of a listener; the secondary group may then collect the remaining channels, particularly those intended for playback behind or to the sides of the listener. By another model, the primary channels may be those intended for playback by audio sources located at substantially the same height as a listener (or a listener's ears) and/or propagating substantially horizontally; the secondary group may then contain the remaining channels, for reproduction at other heights or/and propagating non-horizontally. As still another option, the primary subgroup may be composed of channels to be reproduced in the front half space and at substantially the same height as the listener.

In one embodiment, at least one of the subgroups is associated with an upper bound on the limiting factor for that subgroup. In embodiments where several subgroups are assigned an upper bound on their limiting factor and the method is configured to search for largest possible limiting factor values as solutions, the combination of both limiting factors being equal to their upper bounds is an admissible solution. In this situation, it is preferable to set the upper bounds equal, so that the proportions, as expressed by the predefined maximal downmix coefficients, between input signal from different subgroups are preserved under downmixing.

One embodiment is configured to provide at least two output audio signals corresponding to spatially related channels. Such spatially related channels may belong to one of the following channel groups or a combination of these: front, surround, rear surround, direct surround, wide, centre, side, high, vertical high. The invention teaches to derive one limiting factor for each subgroup in order to satisfy in-range conditions for all output channels jointly. This may translate the perceived spatial balance of the input signals into a corresponding balance of the output signals, and may thus avoid undesirable drift of the perceived location of an audio source and similar problems. In one particular embodiment, the determination of a common limiting factor may happen in two substeps. Firstly, downmix coefficients are determined, as products of the maximal downmix coefficients and preliminary limiting factors, which satisfy the in-range condition on each of the (spatially related) output signals which are derived from input signals in the concerned subgroup. Secondly, the limiting factor to be applied to this subgroup is obtained by extracting the minimum of all preliminary limiting factors derived for said output signals in the first substep.

In one embodiment, an encoding system is adapted to receive a plurality of audio signals, to downmix these into at least one downmix signal in accordance with the invention and to encode the downmix signal(s) as a bit stream.

In one embodiment, a decoding system is adapted to receive a bitstream which encodes audio signals and a downmix specification generated in accordance with the invention. The downmix specification may include downmix coefficients and/or a partition of the signals into subgroups. The decoder is further adapted to downmix the audio signals into at least one downmix signal in accordance with the downmix specification, e.g., by applying the downmix coefficients.

In one embodiment, a decoding system may include an input port, a decoder and a mixer. The decoding system is adapted to decode and downmix a signal in accordance with a specification generated in accordance with the invention. As seen above, the invention teaches that downmix coefficients are downscaled in order to meet an in-range condition by a multiplicative limiting factor that is common within each subgroup of signals. This will imply that ratios of coefficients to be applied to signals in one subgroup are constant, while ratios of coefficients to be applied to signals in different subgroups are variable. Here, the terms "constant" and "variable" refer to the possible variation between different sets of downmix coefficients. For instance, one set of downmix coefficients may be computed for each time segment. However, as the invention teaches, the downmixing system will preserve certain ratios between the downmix coefficients within such sets. Because some of the ratios are variable, the decoding system may be adapted to limit relatively more perceptible signals (e.g., in a primary subgroup) relatively less. This makes it easier to combine a consistent dialogue level with discreet transitions between signal portions with and without gain limiting. If a subgroup contains two or more signals, the decoding system may preserve significant relationships between these signals under its combined decoding and downmixing, so that perceived dynamical, temporal, timbral and/or spatial impressions which are conveyed by the input signals as a whole are only affected to a small extent It is noted that the invention relates to all possible combinations of features recited in the claims.

BRIEF DESCRIPTION OF THE DRAWINGS

The present invention will now be described in more detail with reference to the accompanying drawings, on which.

DETAILED DESCRIPTION OF EMBODIMENTS

Figure 1:
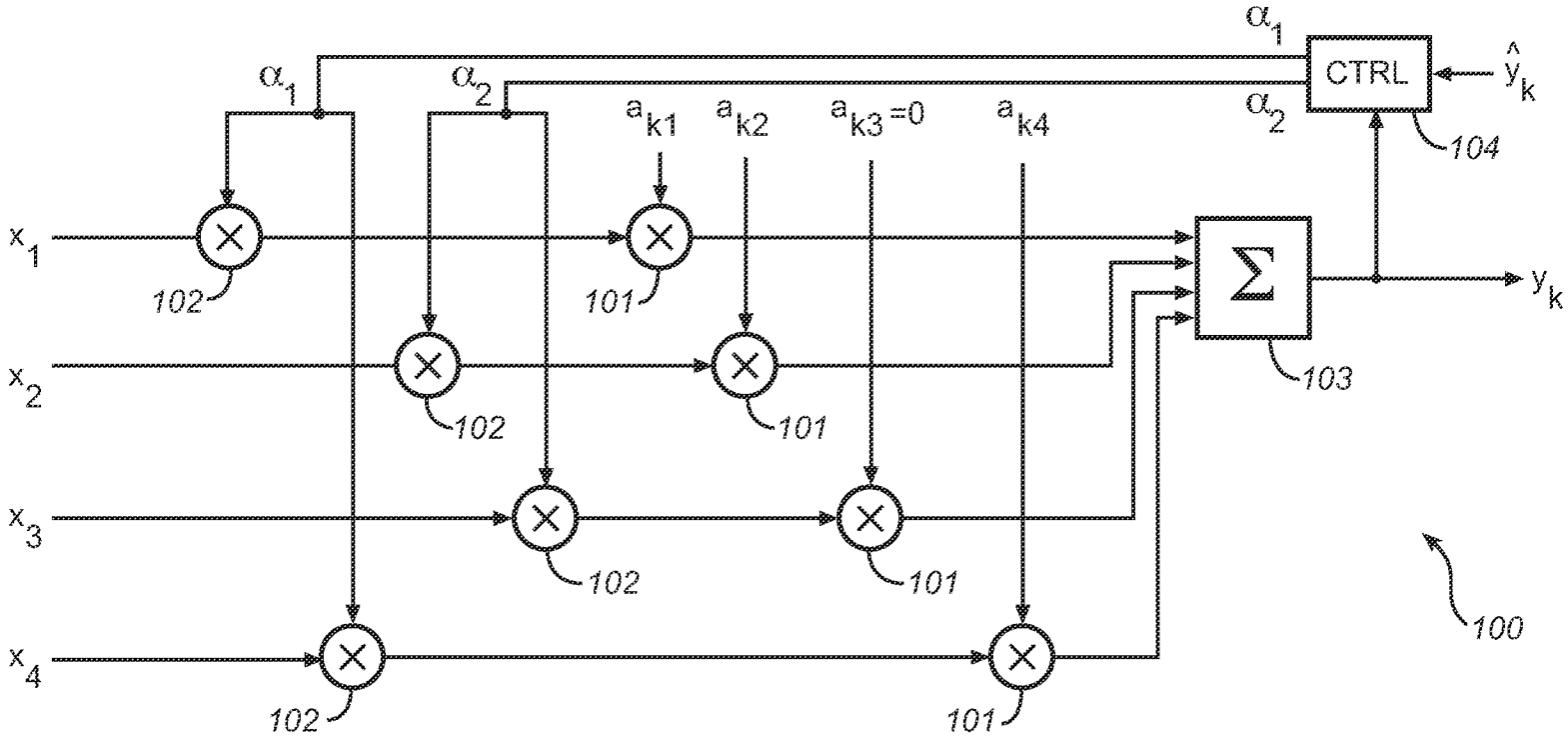
FIG. 1 is a generalised block diagram of a portion of a mixing system according to an embodiment.

FIG. 1 shows a portion of a mixing system 100 in accordance with an embodiment of the invention. The system 100 is adapted to satisfy the following in-range condition on the $k^{th}$ output signal:

$$|y_k| \leq \hat{y}_k \tag{5}$$

First multipliers 101 and a summer 103 compute the $k^{th}$ output signal on the basis of $1^{st}$, $2^{nd}$ and $4^{th}$ input signals as per $$y_k = a_{k1}x_1 + a_{k2}x_2 + a_{k4}x_4,$$

where $a_{k1}$, $a_{k2}$, $a_{k4}$ are predefined maximal downmix coefficients determining the relative weights of the input signals in the absence of limiting. By a predefined partition, the $1^{st}$ and $4^{th}$ input signals belong to a first subgroup, while the $2^{nd}$ and $3^{rd}$ input signals belong to a second subgroup. In view of this partition into subgroups, a controller 104 will attempt to satisfy the in-range condition (5) by choosing values of limiting factor $a_1, a_2 > 0$ in $$y_k = a_1(a_{k1}x_1 + a_{k4}x_4) + a_2 a_{k2}x_2. \tag{6}$$

With reference to FIG. 1, second multipliers 102 apply the limiting factors $a_1$, $a_2$ to the input signals. The controller 104 selects the values of the limiting factors $a_1$, $a_2$ in response to the value of the output signal $y_k$.

With reference now to the whole mixing system 100 discussed above, the action of limiting input signals at downmixing may be expressed as follows in matrix notation. Downmixing without limiting follows a relationship Y=AX, where X, Y are input and output signal vectors and $$A = \begin{bmatrix} a_{11} & \dots & a_{14} \\ \vdots & & \vdots \\ a_{M1} & \dots & a_{M4} \end{bmatrix}.$$

Downmixing with limiting follows the equation $$Y = (\alpha_1 A_1 + \alpha_2 A_2)X$$

with $$A - 1 = \begin{bmatrix} a_{11} & 0 & 0 & a_{14} \\ \vdots & \vdots & \vdots & \vdots \\ a_{M1} & 0 & 0 & a_{M4} \end{bmatrix}$$

and $$A_2 = \begin{bmatrix} 0 & a_{12} & a_{13} & 0 \\ \vdots & \vdots & \vdots & \vdots \\ 0 & a_{M2} & a_{M2} & 0 \end{bmatrix}.$$

Clearly, if one imposes one of the in-range conditions $Y \leq \hat{Y}$, $\check{Y} \leq Y$ and $\check{Y} \leq Y \leq \hat{Y}$, where $\check{Y}$, $\hat{Y}$ are constant vectors, then the limiting factors $a_1$, $a_2$ will be chosen small enough that the in-range conditions on all output signals are satisfied jointly.

The gain limiting according to the invention may be made less perceptible by treating the above subgroups differently. The first subgroup $\{y_1, y_4\}$ may be treated as a primary subgroup, while the second subgroup $\{y_2, y_3\}$ may be treated as a secondary subgroup. For example, the signals in the primary subgroup may correspond to front left and front right signals, which are of primary psychoacoustic significance. Those in the second subgroup may correspond to surround left and surround right, which are intended for playback by non-frontal audio source and therefore carry less significance.

To reflect the unequal significance of the two subgroups, the mixing system 100 according to this embodiment may choose the primary limiting factor from the interval $L_1 \leq a_1 \leq U_1$ and the secondary limiting factor from the interval $L_2 \leq a_2 \leq U_2$. Suitably, $L_1, L_2 > 0$.

This will now be illustrated by an example in which it is assumed that the upper bounds are equal, which preserves the mixing proportions expressed by the maximal downmixing coefficients where this is possible, and are unity, that is $U_1 = U_2 = 1$. Further, it is assumed that $\hat{y}_k = 1$.

Clearly, in a situation where $a_{k1}x_1 + a_{k4}x_4 = 0.5$ and $a_{k2}x_2 = 0.4$ in equation (6), no gain limiting is needed, so that the limiting factors can be set to $(a_1 a_2) = (1,1)$ and still meet the in-range condition, that is, the maximum downmixing coefficients are applied as downmixing coefficients.

Figure 2:
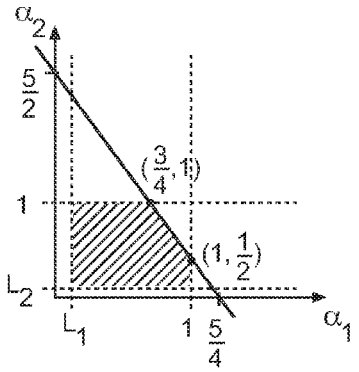
FIG. 2 is a graph illustrating the selection of mixing factors for a primary and a secondary subgroup according to an embodiment.

Now, if $a_{k1}x_1 + a_{k4}x_4 = 0.8$ and $a_{k2}x_2 = 0.4$ in equation (6), then the in-range condition $|y_k| \leq 1$ is satisfied by limiting factor pairs $(a_1, a_2)$ within the pentagonal area with corners at $$(L_1, L_2), (1, L_2), \left(1, \frac{1}{2}\right), \left(\frac{3}{4}, 1\right) \text{ and } (L_1, 1),$$

as shown in FIG. 2. For reasons already stated, the gain is preferably not limited more than necessary and accordingly, the system 100 preferably attempts to find an upper (or 'sharp') solution $y_k = 1$ by selecting limiting factors from the edge segment between $$\left(1, \frac{1}{2}\right) \text{ and } \left(\frac{3}{4}, 1\right).$$

Further, it is advantageous to limit secondary input channels rather than primary input channels, and this translates to selecting a pair of limiting factors at the right extreme (highest $a_1$) on this segment. This leads to the solution $$(\alpha_1, \alpha_2) = \left(1, \frac{1}{2}\right),$$

and the $k^{th}$ output signal will be given by $$y_k = a_{k1}x_1 + a_{k2}x_2 + \frac{a_{k4}}{2}x_4.$$

However, if $$L_2 > \frac{1}{2},$$

then the primary limiting factor $a_1$ will necessarily be less than its upper bound $U_1 = 1$. To favour the primary subgroup over the secondary maximally, the preferred choice of limiting factors is $$(\alpha_1, \alpha_2) = \left(\frac{5}{4} - \frac{L_2}{2}, L_2\right).$$

In variations to this embodiment where the system 100 is configured to search for limiting factors in a different way than described in the example of the preceding paragraph, the primary subgroup may be favoured by being associated with a greater lower bound than the secondary subgroup, that is, $L_1 > L_2$.

In one embodiment, the mixing system 100 may determine suitable upper and lower bounds on the limiting factors on the basis of the maximal downmix coefficients. If the in-range condition is $-1 \le Y \le 1$, a number $W \le 1$ is given and the bounds are written on the form $$L_1 = m_P W,\ L_2 = m_S W,\ U_1 = U_2 = W, \tag{7}$$

then this embodiment uses $$m_S = \min\left\{Q, \frac{1}{W(P+S)}\right\},\ m_P = \frac{1}{P}\left(\frac{1}{W} - m_S S\right), \tag{8}$$

where P is the sum of the absolute values of the downmix coefficients applied to the signals in the primary subgroup and S is the sum of the absolute values of the downmix coefficients applied to the signals in the secondary subgroup. By varying the value of constant $0 < Q < 1$, the system's 100 tendency to limit secondary signals rather than primary signals can be made more or less pronounced. In the example discussed above, $P = |a_{k1}| + |a_{k2}|$ and $S = |a_{k2}|$.

Figure 3A:
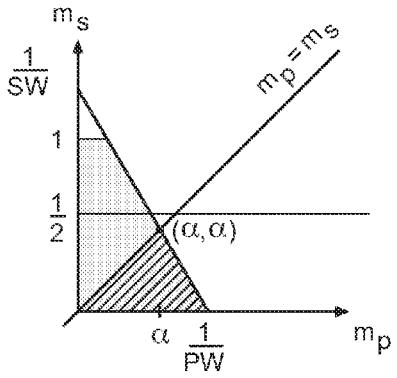
FIG. 3 are two graphs illustrating the selection of admissible intervals for limiting factors on the basis of maximal downmix coefficients according to an embodiment.
Figure 3B:
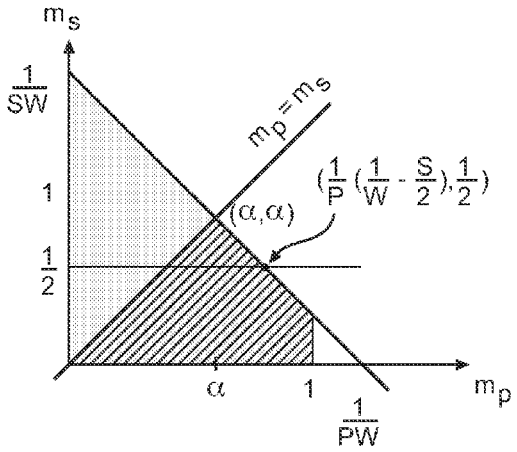

In FIGS. 3A and 3B, the dotted areas represent choices ($a_1$, $a_2$) of limiting factors that satisfy the double inequality $$-1 \le W(m_P P + m_S S) \le 1,$$

which is what the above in-range condition amounts to in the worst-case situation of all input signals having unity magnitude and of equal signs as the downmix coefficients, that is, for some k, $a_{k1}x_1 = |a_{k1}|$ for all l or $a_{k1}x_1 = -|a_{k1}|$ for all l. The hashed sub-areas represents choices of limiting factors for which primary signals are limited less than secondary signals. The lower bounds in formulas (7), (8) represent choices of limiting values for which the in-range condition is just satisfied (i.e., satisfied 'sharply') in the worst case. For the purpose of illustration, the constant Q has been set to ½. This embodiment is based on the realisation that limiting factors need never be chosen smaller than these values. Having understood this exemplifying embodiment, those skilled in the art will be able to generalise it to other in-range conditions than $-1 \le Y \le 1$.

Figure 4:
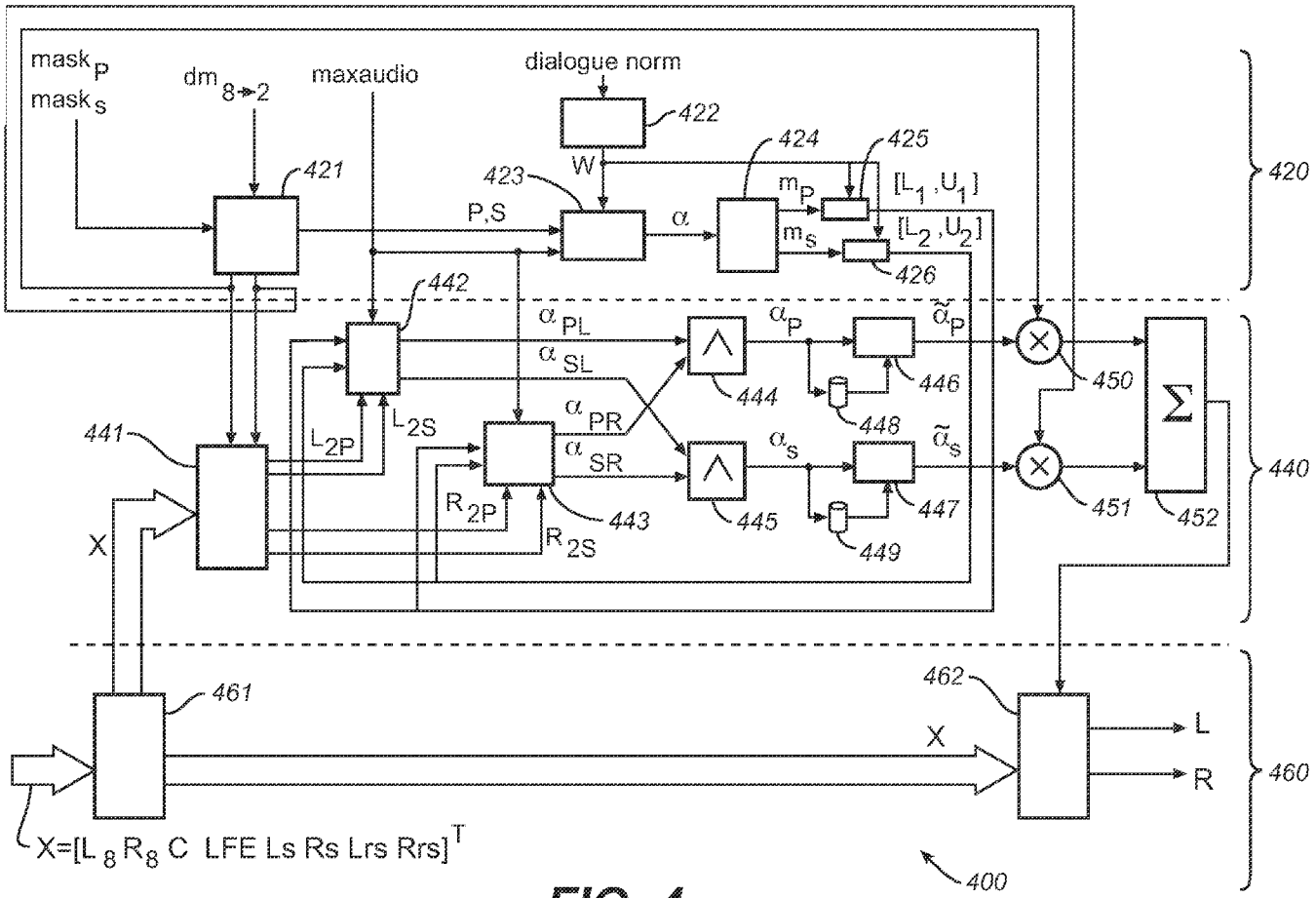
FIG. 4 is a generalised block diagram of a mixing system according to an embodiment.

FIG. 4 shows a mixing system 400 for downmixing eight audio channels into two channels. It may be argued that the system 400 has a three-layered structure comprising a configuring section 420, a controller (gain limiting section) 440 and a mixing section 460. The configuring section 420 is adapted to determine suitable intervals for limiting factors on the basis of parameters configuring the properties of the system 400. The limiting controller 440 is adapted to determine the values of the downmix coefficients to be applied by the mixing section 460 on the basis of the intervals supplied by the configuring section 420 and further on the basis of certain input data supplied by the mixing section 460. The mixing section 460 is adapted to receive a vector of input audio signals $X = [L_8\ R_8\ C\ LFE\ Ls\ Rs\ Lrs\ Rrs]^T$ and to downmix these into a vector of output audio signals $Y = [L\ R]^T$ by means of a mixer 462 and using the downmix coefficients.

The mixing system 400 is adapted to handle signals partitioned into time segments. As an example, the signals may be conformal to the digital distribution format described in the paper J. R. Stuart et al., "MLP lossless compression", Meridian Audio Ltd., Huntingdon, England, which is hereby incorporated by reference. In this distribution format, blocks (or access units) are formed from between 40 and 160 samples, and packets (corresponding to restart intervals) are formed from a fixed number of blocks. A packet, which may consist of 128 blocks and include a restart header, will be regarded as a time segment for the purposes of this example.

The configuring section 420 includes a unit 421 for receiving a matrix of maximal downmix coefficients $$dm_{8\to 2} = \begin{bmatrix} 1 & 0 & 10^{-3/20} & 0 & 1 & 0 & 1 & 0 \\ 0 & 1 & 10^{-3/20} & 0 & 0 & 1 & 0 & 1 \end{bmatrix}$$

and for receiving masking matrices $$mask_P = \begin{bmatrix} 1 & 1 & 1 & 0 & 0 & 0 & 0 & 0 \\ 1 & 1 & 1 & 0 & 0 & 0 & 0 & 0 \end{bmatrix}$$

$$mask_S = \begin{bmatrix} 0 & 0 & 0 & 0 & 1 & 1 & 1 & 1 \\ 0 & 0 & 0 & 0 & 1 & 1 & 1 & 1 \end{bmatrix}$$

which define a partition of the input signals into a primary subgroup ($L_8$, $R_8$, C, which are intended for playback in front of a listener and at approximate ear level) and a secondary subgroup (Ls, Rs, Lrs, Rrs). A third subgroup containing only the low-frequency effects (LFE) channel will not contribute to any output signals in this mixing system 400. The receiving unit 421 computes the numbers P,S referred to above and forms masked mixing matrices $$\text{primary}_{8\to 2} = \text{mask}_p \cdot dm_{8\to 2},$$
$$\text{secondary}_{8\to 2} = \text{mask}_S \cdot dm_{8\to 2},$$

where · denotes element-wise (or Hadamard) matrix multiplication. Since the maximal downmix coefficients are symmetric, the numbers are $$P = 1 + 10^{-3/20} \text{ and } S = 1 + 1 = 2.$$

The configuring section 420 further comprises units 423, 424, 434 for computing upper and lower bounds on the respective limiting factors for the primary and secondary subgroups. A first unit 423 determines an intermediate value $$\alpha = \frac{1}{W(P+S)}$$

based on the value of a parameter maxaudio determining the in-range condition to be applied, the values of P, S obtained from the receiving unit 421 and further based on a common upper bound w on the primary and secondary limiting factors. The value of the upper bound mW may be supplied directly to the first unit 423 as a configuration parameter to the system 400. It may also, as shown in FIG. 4, be supplied by a converter 422 for calculating the upper bound W on the basis of dialogue norm values; as an illustrative example, the upper bound may be given by the relationship $$W=10^{(dialnorm_{8ch}-dialnorm_{2ch})/20},$$

where $dialnorm_{8ch}$ denotes the dialogue norm pertaining to the 8-channel input representation of the audio and $dialnorm_{2ch}$ is the desired dialogue norm in the 2-channel output representation. Returning to the computation of the upper and lower bounds, a second unit 424 is adapted to evaluate, based on a, the variables $m_P$,$m_S$ given by equations (8). Finally, third and fourth units 425, 426 are adapted to receive $m_P$, W and $m_S$, W respectively, and to derive the primary and secondary upper and lower bounds on the limiting factors using equations (7).

Turning now to the controller 440, output channel L has an associated limiter 442 for determining what values the primary and secondary limiting factors $a_{PL}$, $a_{SL}$ are required to have in order to satisfy the in-range condition defined by the parameter maxaudio. The limiter 442 determines the values for one time segment at a time and may be configured to carry this out in the manner described previously, favouring the primary input signals over the secondary ones. For a given time segment, the limiter 442 bases its decisions on the in-range parameter maxaudio, on the intervals $[L_1, U_1]$, $[L_2, U_2]$ in which the limiter 442 is permitted to chose the limiting factors $a_1$, $a_2$, and further on input signal data for the time segment. In this embodiment, the input data is supplied from a preliminary mixer 441 to the limiter 442 in the form of signals $L_{2P}$, $L_{2S}$ given by $$\begin{bmatrix} L_{2P} \\ R_{2P} \end{bmatrix} = primary_{8\to 2}x \text{ and } \begin{bmatrix} L_{2S} \\ R_{2S} \end{bmatrix} = secondary_{8\to 2}X.$$

The preliminary mixer 441 is communicatively connected to an input port 461 to obtain the input signals X or, possibly, a subset (e.g. not including LFE) sufficient to compute $L_{2P}$, $L_{2S}$, $R_{2P}R_{2S}$. A limiter 443 for the other output channel R is configured in a similar manner as the L limiter 442, except that it receives signals $R_{2P}$, $R_{2S}$ in lieu of $L_{2P}$, $L_{2S}$ and outputs $a_{PR}$, $a_{SR}$.

Subsequently, to restore the balance between the input channels going to the output channels, the left and right primary limiting factors $a_{PL}$, $a_{PR}$ are fed to a minimum extractor 444 adapted to return $a_P=\min\{a_{PL}, a_{PR}\}$. Similarly, the left and right secondary limiting factors $a_{SL}$, $a_{SR}$ are supplied to a further minimum extractor 445 configured to output $a_S=\min\{a_{SL}, a_{SR}\}$.

In this embodiment, smoothing of the time sequence of primary and secondary limiting factors $a_P(n)$, $a_S(n)$, where n is a time-segment index, is performed by regularisers 446, 447 which return smoothed sequences of limiting factors $\tilde{a}_P(n)$, $\tilde{a}_S(n)$. The functioning of the regularisers 446, 447 will be described in more detail below. In this embodiment, the regularisers 446, 447 are assisted by respective buffers 448, 449 enabling the regularisers 446, 447 to operate on more values of the limiting factor than the current one. The buffers 448, 449 may be realised as shift registers.

As a final step to be carried out by the controller 440, multipliers 450, 451 and a summer 452 compute, using the smoothed limiting factors and the masked mixing matrices, the following downmix matrix to be applied in the $n^{th}$ time segment:

$$\tilde{a}_P(n)primary_{8\to 2}+\tilde{a}_S(n)primary_{8\to 2}.$$

As has been already mentioned, the mixing section 460 comprises an input port 461 for receiving the input signals X and for supplying these to the preliminary mixer 441. The input port 461 further provides the input signals X to a mixer 461, which is adapted to receive the downmix matrix and to evaluate the equation $$Y=(\tilde{a}_P(n)primary_{8\to 2}+\tilde{a}_S(n)primary_{8\to 2})X.$$

Figure 5:
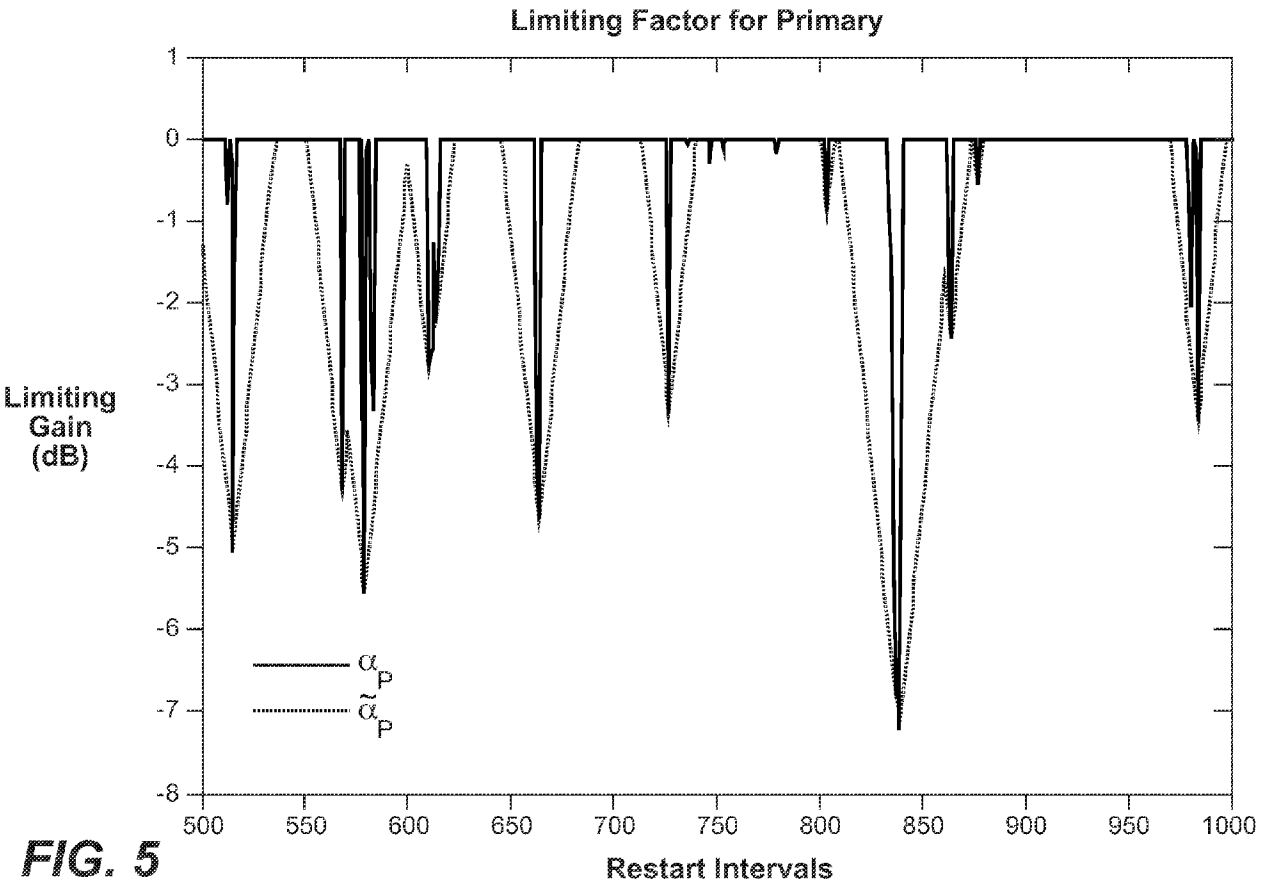
FIG. 5 illustrates a smoothing process forming part of an embodiment.

FIG. 5 shows an example of the smoothing provided by one or both of the regularisers 446, 447. Limiting factors before smoothing (upper curve) and after smoothing (lower curve) have been plotted in a semi-logarithmic diagram. The sharp downward peaks in the non-smoothed values, which may be occasioned by high input signal values, correspond to broadened peaks in the smoothed values in order to ensure that a greatest (absolute) rate-of-change condition is satisfied. In this example, the broadening is double sided. Further, both the location and the amplitude of the peak are preserved. It is possible to achieve this by means of a look-ahead filter. For the acceptable rate of change $R_m$ [signal units per time segment] and the maximal expected change in signal magnitude $A_m$ [signal units] a suitable number of taps is $A_m/R_m$, and the look-ahead period will be approximately the number of taps multiplied by the segment length. In the smoothing, as already noted, it is not advisable to adjust individual segment-wise values of downmix coefficients by increasing them, as this may violate the in-range condition in time segments affected by smoothing.

In an analogue implementation, the regularisers 446, 447 may be realised by rate-limiting filters of the kind exemplified by U.S. Pat. No. 3,252,105, which is hereby incorporated by reference. Such filters are preferably applied in conjunction with appropriate delay lines to ensure sufficient synchronicity of the limiting factors and the input signals to be downmixed. In the embodiment shown in FIG. 4, a delay line may be arranged between the input port 461 and the mixer 462 and may correspond to the size of buffers 448, 449.

Further embodiments of the present invention will become apparent to a person skilled in the art after studying the description above. Even though the present description and drawings disclose embodiments and examples, the invention is not restricted to these specific examples. Numerous modifications and variations can be made without departing from the scope of the present invention, which is defined by the accompanying claims.

The systems and methods disclosed hereinabove may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

The invention claimed is:

1. A method of downmixing a plurality of input audio signals containing input data into at least two output audio signals corresponding to spatially related channels, wherein maximal downmix coefficients are predefined, at least one in-range condition on each of the at least two output audio signals is predefined and the input audio signals are partitioned into predefined subgroups, wherein at least one of the subgroups comprises two or more input audio signals, the in-range condition on each of the at least two output audio signals being an upper bound on the output audio signal or a lower bound on the output audio signal or a requirement for the output audio signal to remain in an interval having a lower and an upper bound, the method comprising:

determining a limiting factor for each subgroup;

determining downmix coefficients for each subgroup as products of the maximal downmix coefficients for the subgroup and the limiting factor for the subgroup;

applying the downmix coefficients to downmix the plurality of input audio signals into the at least two output audio signals corresponding to spatially related channels, wherein determining the limiting factor for a subgroup includes the substeps of:

determining, for each of the output audio signals to which the input audio signals in the subgroup contribute, a preliminary limiting factor for the subgroup, in order to satisfy, in view of the input data, the in-range condition on the output audio signal; and determining, as the limiting factor for the subgroup, the minimum of the preliminary limiting factors for the subgroup, in order to jointly satisfy, in view of the input data, the in-range condition on each of the output audio signals.

2. The method of claim 1, wherein input audio signals in a subgroup correspond to spatially related audio channels, preferably comprising:

a left and a right channel, or a left, a right and a centre channel.

3. The method of claim 1, wherein the downmix coefficients are determined in such manner that the in-range condition will be satisfied by at most 20 percent margin.

4. The method of claim 1, wherein the output audio signals are partitioned into time segments, and wherein a segment-wise set of downmix coefficients is determined for each of a plurality of time segments as products of said maximal downmix coefficients of the subgroup and the limiting factor of the subgroup in order to satisfy, independently in view of the input data in this time segment, an upper output-signal bound.

5. The method of claim 4, wherein a segment-wise set of downmix coefficients is determined for each of a plurality of time segments as products of said maximal downmix coefficients of the subgroup and the limiting factor of the subgroup in order to jointly satisfy an in-range condition on each of said at least two spatially related output audio signals, independently in view of the input data in this time segment.

6. The method of claim 5, further comprising:

defining a sequence of segment-wise values of a downmix coefficient from said segment-wise sets of downmix coefficients;

smoothing the sequence of segment-wise values of the downmix coefficient; and applying the smoothed segment-wise values to downmix the input audio signals.

7. The method of claim 6, wherein the sequence of segment-wise values is smoothed by applying an upper rate-of-change bound, wherein preferably the sequence of segment-wise values is smoothed by maintaining or decreasing the segment-wise values in order to satisfy the upper rate-of-change bound.

8. The method of claim 1, wherein at least one subgroup is associated with a lower bound on the limiting factor for that subgroup.

9. The method of claim 8, wherein a primary and secondary subgroup are defined, and a lower bound on the limiting factor associated with the primary subgroup is greater than a lower bound on the limiting factor associated with the secondary subgroup.

10. The method of claim 1, wherein a primary and a secondary subgroup are predefined and the primary subgroup is associated with an upper bound on the limiting factor, and wherein said determining downmix coefficients includes favouring the upper bound on the limiting factor for the primary subgroup as a value of the limiting factor for the primary subgroup.

11. The method of claim 10, wherein a primary and a secondary subgroup are predefined and each is associated with a respective lower bound and a respective upper bound on the limiting factors ($L_1 \leq \alpha_1 \leq U_1$, $L_2 \leq \alpha_2 \leq U_2$), and wherein said determining downmix coefficients includes the substeps of:

initially attempting to satisfy the in-range condition on each of the at least two output audio signals in the subspace of limiting factors such that the primary-subgroup limiting factor is equal to its upper bound ($\alpha_{1=U1}$, $L_2 \leq \alpha_2 \leq U_2$);

further, if the initial attempt fails, attempting to satisfy the in-range condition on each of the at least two output audio signals in the subspace of limiting factors such that the secondary-subgroup limiting factor is equal to its lower bound ($L_1 \leq \alpha_1 \leq U_1$, $\alpha_{2=L2}$).

12. The method of claim 9, wherein:

the primary subgroup corresponds to channels from one of the following groups:

(i) channels for playback by audio sources located in a front half space with respect to a listener, (ii) channels for playback by audio sources located at substantially the same height as a listener; and the secondary subgroup corresponds to channels other than (i) or (ii).

13. The method of claim 12, wherein:

the primary subgroup corresponds to channels from one of the following groups:

(iii) front channels, (iv) centre channels, (v) wide channels; and the secondary subgroup corresponds to channels other than (iii), (iv) or (v).

14. The method of claim 1, wherein at least one subgroup is associated with an upper bound on the limiting factor.

15. The method of claim 14, wherein two or more subgroups are associated with a common upper bound on the limiting factor.

16. The method of claim 1, wherein said spatially related channels, to which the output signals correspond, belong to one of the following channel groups:

front, surround, rear surround, direct surround, wide, centre, side, high, vertical high.

17. A method of encoding a plurality of audio signals as a bit stream, comprising:

receiving the plurality of audio signals;

downmixing the audio signals into a downmix signal according to the downmixing method of claim 1; and encoding the downmix signal as a bit stream.

18. A method of decoding a bit stream containing a plurality of encoded audio signals and mixing coefficients determined in response to downmix coefficients determined according to the downmixing method of claim 1, the method comprising:

receiving the bit stream; and decoding the encoded audio signals; and mixing the encoded audio signals into a downmix signal in accordance with the mixing coefficients.

19. A non-transitory data carrier storing computer-executable instructions for performing the method of claim 1.

20. A mixing system comprising:

an input port for receiving a plurality of input audio signals containing input data;

a configuring section for receiving maximal downmix coefficients, an in-range condition on each of at least two output audio signals corresponding to spatially related channels, and a partition of the input audio signals into subgroups, wherein at least one of the subgroups comprises to or more input audio signals;

the in-range condition on each of the at least two output audio signals being an upper bound on the output audio signal or a lower bound on the output audio signal or a requirement for the output audio signal to remain in an interval having a lower and an upper bound, a controller for determining:

a limiting factor for each subgroup; and downmix coefficients for each subgroup as products of the maximal downmix coefficients for the subgroup and the limiting factor for the subgroup; and a mixer for applying the downmix coefficients determined by the controller to downmix said plurality of input audio signals into the at least two spatially related output audio signals;

wherein the controller comprises a processor configured to determine the limiting factor for a subgroup by:

determining, for each of the output audio signals to which the input audio signals in the subgroup contribute, a preliminary limiting factor for the subgroup, in order to satisfy, in view of the input data, the in-range condition on the output audio signal; and determining, as the limiting factor for the subgroup, the minimum of the preliminary limiting factors for the subgroup, in order to jointly satisfy, in view of the input data, the in-range condition on each of the output audio signals.

* * * * *